US006129076A

United States Patent [19]

Powell et al.

[11] Patent Number: 6,129,076

[45] Date of Patent: Oct. 10, 2000

[54] THROWING APPARATUS AND METHOD

[76] Inventors: Richard O. Powell, 3703 Indian Point Dr., Austin, Tex. 78739; Bert L. Powell, Jr., 9212 Chisholm La., Austin, Tex. 78748

[21] Appl. No.: 09/289,264

[22] Filed: Apr. 9, 1999

[51] Int. Cl.[7] ..... F41B 3/03

[52] U.S. Cl. ..... 124/7; 124/36

[58] Field of Search ..... 124/7, 36

[56] References Cited

U.S. PATENT DOCUMENTS

| | | | |
|---|---|---|---|
| 1,162,910 | 12/1915 | Goude | 124/7 |
| 1,912,360 | 6/1933 | Blanchard | 124/7 |
| 2,080,958 | 5/1937 | Beasley et al. | 124/7 |
| 2,082,818 | 6/1937 | Atwell | 124/7 X |
| 4,111,179 | 9/1978 | Hashimoto | 124/7 |
| 4,844,045 | 7/1989 | Powell et al. . | |
| 4,860,717 | 8/1989 | Powell et al. . | |
| 4,907,802 | 3/1990 | Gatin | 124/7 |
| 4,995,371 | 2/1991 | Kuizinas | 124/7 |
| 5,660,386 | 8/1997 | Krieger | 124/7 |

*Primary Examiner*—John A. Ricci

*Attorney, Agent, or Firm*—J. Nevin Shaffer, Jr.; Shaffer & Culbertson, LLP

[57] ABSTRACT

A throwing apparatus and method (10) having a base (12), an arm axle mount (14), a throwing arm (16), a release handle (18), and a power section (20). Throwing arm (16) is rotatably connected by means of axle (46) near the bottom (28) of throwing arm (16) to arm axle mount (14). Arm axle mount (14) is located near the front (22) of base (12). The bottom (28) of throwing arm (16) is connected to one end (48) of power section (20). The other end (50) of power section (20) is connected to one of a number of speed adjustment connection locations (52) in base (12). Release handle (18) is movably connected near the back (24) of base (12) and includes release block (62). When the top (26) of throwing arm (16) is pulled in the rearward position towards the back (24) of base (12), release block (62) is pressed by release handle (18) over the top (26) of throwing arm (16) thereby holding throwing arm (16) in the rearward cocked position. An object to be thrown (78) is placed in the "V" shaped form of throwing arm (16). In a preferred embodiment, the ball (78) rests on micro-vertical adjuster (34) connected to throwing arm (16). Additionally, in a preferred embodiment, a macro-vertical adjuster (60) is connected to release handle (18). By means of adjustment of micro-vertical adjuster (34) and macro-vertical adjuster (60), ball (78) when thrown by pulling back on release handle (18), can be accurately and consistently thrown at the desired height, distance and speed.

20 Claims, 2 Drawing Sheets

80

SPEED CHART:

| MPH | EYEBOLT POSITION | RELEASE BLOCK POSITION | DISTANCE |
|---|---|---|---|
| 20-22 | 1 | #2-5 | 30-39 FT. |
| 25-27 | 2 | #3-5 | 39-44 FT. |
| 33-35 | 3 | #4-6 | 44-49 FT. |

THROWING APPARATUS AND METHOD

BACKGROUND OF THE INVENTION

This invention relates to an improved throwing apparatus and method for throwing objects.

In particular, this invention relates to an improved throwing apparatus and method for throwing balls.

Both manual and automatically driven throwing devices have been known in the art for quite some time. In particular, in the field of throwing balls, and more particularly baseballs, a wide variety and assortment of devices are known. Electrical devices are known that shoot balls between wheels at a batter. The problem with these electrical throwing devices is that they impart unnatural spin to the ball and are erratic and difficult to adjust. Also, they are expensive and difficult to use in a real baseball setting since there are no electrical outlets at the pitcher's mound in a typical baseball field.

Manual devices are known which remove the necessity for providing electricity to the pitcher's mound. Nonetheless, none of the prior art devices known in the art are simple to use, compact in form, and do not obstruct a lot of the baseball playing field when set up. An example of such manual devices are applicants' prior inventions disclosed in Powell et al. U.S. Pat. Nos. 4,860,717 and 4,844,045. These patents disclose a mechanical ball throwing device designed to be operated remotely at the batter's box by the batter or a coach standing behind the batter. These devices require the use of an arm positioning means, a long cord, to draw the throwing arm back into throwing position. The set up of these inventions a pegboard to be inserted in front of the batter across the batting plate, or in front or behind it, and the throwing machine to be manipulated at the pitcher's mound until some desired location of the throwing arm and attached "hand" is achieved. By these methods of moving the pegboard and the machine, the device can "adjust" the pitch as desired. Further, the hand portion for holding the ball is comprised of a pair of spaced, substantially parallel, members for releasably supporting the ball to be thrown. These spaced members are essentially round aluminum tubes spaced apart so that the ball fits in the space between them. In addition to the fact that these prior art inventions obstruct a large amount of the playing surface with lines, boards and the like and were not easily adjustable, the hand of the prior art inventions would often spread apart during the throwing motion and inadvertently grip the ball and would impart unpredictable spin and motion to the ball. Additionally, the parallel tubes were incapable of holding a variety of sizes of balls, from baseballs to softballs, without totally restructuring or rebuilding the hand to accommodate a particular ball size. Still further, these prior art inventions required a shock absorber to stop the arm in the forward position after the ball had been thrown.

Thus, there is a need in the art for providing a throwing apparatus and method that is non-electric, portable, compact, easily adjustable and capable of accurately throwing a variety of balls simply and inexpensively. It, therefore, is an object of this invention to provide an improved throwing apparatus and method for throwing objects, such as baseballs, which is capable of throwing a variety of sizes of balls accurately, and which can easily adjust the location of the ball as it crosses the plate.

SHORT STATEMENT OF THE INVENTION

Accordingly, the throwing mechanism of the present invention includes a base with a front and back. An arm axle mount is connected to the front of the base. A throwing arm with a top and a bottom is connected to the arm axle mount. A release handle is connected to the back of the base for releasing the top of the throwing arm once the throwing arm is placed in a rearward pre-throwing position. Further, a power section is connected to the bottom of the throwing arm and to the base to provide throwing motion and power to the throwing arm and also stops the arm after the ball is released so no extra shock absorber is necessary.

In a preferred embodiment, the throwing arm is formed from a pair of non-parallel flat surfaces joined together along one edge so as to form a "V" shape into which an object to be thrown, such as a ball, is placed for throwing. In a further preferred embodiment, a macro-vertical adjuster is attached to the release handle for large adjustments of the vertical location of the ball as it crosses a plate and a micro-vertical adjuster is attached to the throwing arm to provide for small accurate adjustments of the location of the ball in a vertical direction as it crosses the plate.

Also in a preferred embodiment, a number of speed adjustment connection locations are provided in the base so that through a combination of these speed adjustment connection locations, the macro-vertical adjuster, and the micro-vertical adjuster, a wide range of speeds and distances are obtainable without reduction of accuracy.

BRIEF DESCRIPTION OF THE DRAWINGS

Other objects, features, and advantages of the present invention will become more fully apparent from the following detailed description of the preferred embodiment, the appended claims, and the accompanying drawings in which:

DETAILED DESCRIPTION OF THE PREFERRED EMBODIMENT

Figure 1:
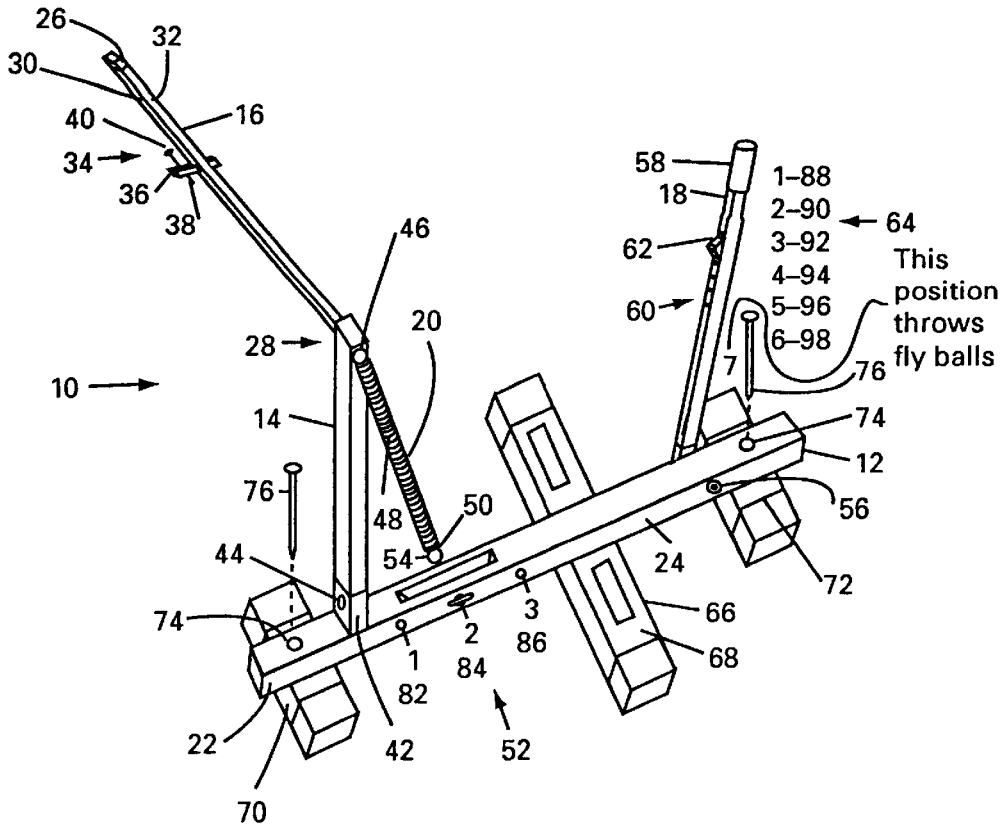
FIG. 1 is a plan view of a preferred embodiment of the throwing mechanism of the present invention shown in the uncocked resting position.

The preferred embodiment of the present invention is illustrated by way of example in FIGS. 1–4. With specific reference to FIG. 1, throwing apparatus 10 includes base 12, arm axle mount 14, throwing arm 16, release handle 18 and power section 20. Base 12 has a front 22 and a back 24. Throwing arm 16 has a top 26 and a bottom 28. In a preferred embodiment, throwing arm 16 is constructed of a pair of non-parallel flat surfaced ridged materials, such as aluminum, iron, rigid pvc, or the like. One rectangularly shaped elongated flat section 30 is joined to another flat section 32 along one edge so as form a "V" into which an object to be thrown, such as a ball, is placed. In a preferred embodiment, the connection of flat section 30 and flat section 32 along one edge is made so as to create a 90° angle forming the "V" into which a ball is placed for throwing.

Throwing arm 16 also includes a micro-vertical adjuster 34. In a preferred embodiment, micro-vertical adjuster 34 includes support 36 and moveable platform 38. Support 36 is a block of any appropriate rigid material such as pvc, aluminum or the like. Moveable platform 38 can take the form of any adjustable rigid device such as a carriage bolt threaded to support 36 so as to enable incremental adjustments up and down. Moveable platform 38 has a flat support top 40, in a preferred embodiment, upon which the object to be thrown, such as a ball, rests.

As shown in FIG. 1, arm axle mount 14 is secured to the front 22 of base 12 by any means known in the art. In a preferred embodiment, arm axle mount 14 is placed in female receiver 42. Female receiver 42 is secured to front 22 of base 12 in any appropriate manner, such as by welding, glues or the like. In a preferred embodiment, arm axle mount 14 once placed in female receiver 42 is secured in place by bolt and nut 44. Certainly any means for securing arm axle mount within female receiver 42 is appropriate. The use of bolt and nut 44, however, enables arm axle mount 14 to be removed for storage and transportation, and the like. Arm axle mount 14 further includes axle connection 46 to which throwing arm 16 is rotatably connected near the bottom 28 of throwing arm 16. Axle connection 46 is of any type known in the art that provides a secure yet moveable connection. The very bottom 28 of throwing arm 16 is connected to power section 20. Power section 20 is made of any resilient stretchable material known in the art such as surgical tubing, stretchable elastic hosing, springs, or the like. One end 48 of power section 20 is connected to the bottom 28 of throwing arm 16. The other end 50 of power section 20 is moveably connected to base 12.

In a preferred embodiment, base 12 includes a multiple speed adjustment connection location 52. As will be described hereafter, end 50 of power section 20 may be moveably connected to base 12 through use of speed adjustment connection location 52. The connection of end 50 of power section 20 to base 12 at speed adjustment connection location 52 may be by any means known in the art such as eye bolt 54, or any other easily removably attachable securing device now known or hereafter developed.

As illustrated in FIG. 1, release handle 18 is moveably connected to base 12 at connection 56. Connection 56 can be any connection known in the art, such as a bolt and nut combination, or the like. Importantly, whatever connection 56 is made for release handle 18, release handle 18 must be free to rotate back and forth toward the front 22 of base 12 and the back 24 of base 12. Release handle 18 further includes a release handle grip 58, preferably of contemporary design conformed to the fingers of a hand for ease and comfort of gripping. Release handle grip 58 may be made of rubber, plastic, or any other suitable material.

Importantly, release handle 18 further includes macro-vertical adjuster 60. Macro-vertical adjuster 60, in a preferred embodiment includes release block 62 movably connected to release handle 18 at pitch height adjustment holes 64. Release block 62 is movably connected through pitch height adjustment holes 64 to release handle 18 by any convenient means known in the art such as bolts and wing nuts. Release block 62, in a preferred embodiment, is trapezoidal in shape having a flat side secured to the flat face of release handle 18 and two angled sides angling toward each other from the connection on release handle 18. As a result, in a preferred embodiment release block 62 includes an angled smooth face for engaging and smoothly releasing the top 26 of throwing arm 16 as will be more fully described hereafter.

In a further embodiment, throwing apparatus 10 further includes transverse stability bars 66 as illustrated in FIG. 1. In a preferred embodiment, the transverse stability bars 66 take the form of a central elongated transverse stability bar 68 with a shorter front pad transverse stability bar 70 and shorter rear pad transverse stability bar 72. Obviously, any size, combination or number of transverse stability bars 66 may be utilized so long as throwing apparatus 10 is prevented from rocking side to side as the device is utilized, as will be more fully described hereafter.

Finally, in the preferred embodiment, stake holes 74 are provided in front 22 and back 24 of base 12 for use with stake 76. If necessary, stake 76 can be used to secure base 12 in location by driving stake 76 through stake hole 74 into the dirt or other playing surface as appropriate so as limit movement of throwing apparatus 10 in use.

FIG. 1 discloses and illustrates throwing apparatus 10 in an "uncocked" resting position. The resilient nature of power section 20 holds throwing arm 16 in a fixed resting position as illustrated, which changes depending upon the selection of speed adjustment connection location 52 to which end 50 of power section 20 is secured. In any event, when in the resting position, the throwing apparatus 10 of the present invention when fully assembled, appears as illustrated in FIG. 1.

Figure 2:
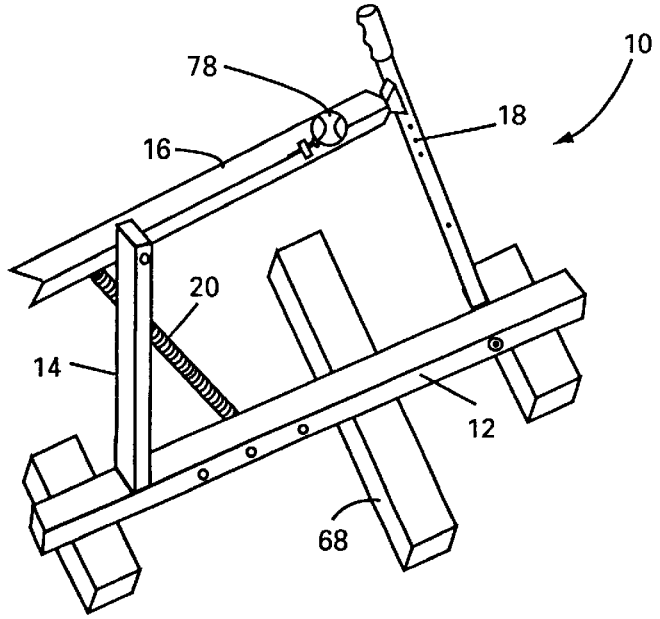
FIG. 2 is a plan view of the invention of FIG. 1 showing the arm in the cocked position with a ball held in the throwing arm.
Figures 3, 4:
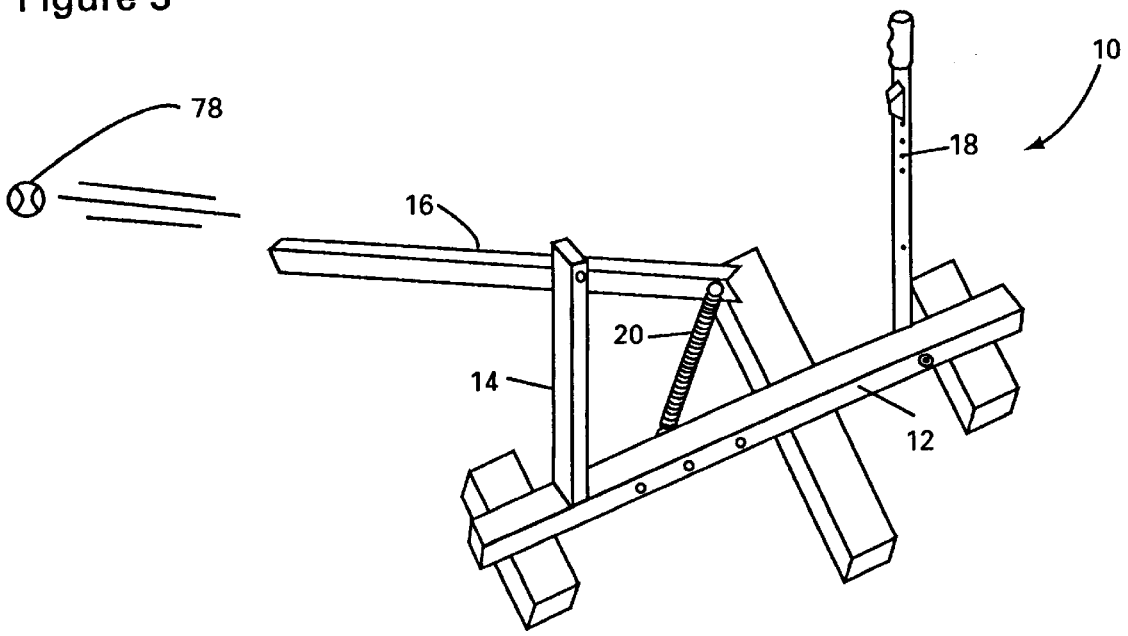
FIG. 3 is a plan view of the invention of FIG. 1 with the throwing arm in the forward-most ball throwing position.
FIG. 4 is a speed and distance chart illustrating the variety of speeds and distances obtainable through simple adjustments of the invention shown in FIG. 1.

Referring now to FIGS. 2 and 3, the operation of throwing apparatus 10 is further described. Referring to FIG. 2, throwing apparatus 10 is shown in the "cocked", armed position. In this position, throwing arm 16 has been pulled rearward toward the back 24 of base 12. Throwing arm 16 is pulled rearward far enough so that release block 62 can be passed over the top 26 of throwing arm 16. In order to prevent the release of throwing arm 16 in the tensioned cocked position, the user must not release handle grip 58 and must hold it in the forward position towards the front 22 of base 12. This is necessary because of the angled face of release block 62 and the moveable connection 56 of release handle 18 to base 12. Thus throwing apparatus 10, as a result, is constructed so that if a user does not hold release handle 18 in the forward position thereby holding top 26 of throwing arm 16 in the rearward cocked position, the top 26 of throwing arm 16 will slide up the smooth angled face of release block 62 to return throwing arm 18 to the uncocked resting position. Throwing apparatus 10 has been designed this way so as to insure that the device may not be left in the cocked, armed position such as illustrated in FIG. 2, where throwing arm 16 has rotated around axle 46 at throwing arm's 16 connection just above the bottom 28 of throwing arm 16. Because power section 20 connection 48 is connected to the bottom 28 of throwing arm 16, this rearward movement of the top 26 and forward movement of the bottom 28 stretches power section 20 creating potential energy so long as release handle 18 is held in the forward position as previously described. Object to be thrown 78, a ball of any size, is placed in the "V" shaped trough formed by flat sections 30 and 32. The two rigid connected flat sections 30 and 32 provide a smooth surface for ball 78 to rest on which cannot be forced apart during the force of the throw, as is a serious problem with prior art devices. The unique "V" shaped flat section surface of throwing arm 16 can thereby accommodate any size of ball 78 whether it be a wiffle ball, baseball, softball, etc.

In a preferred embodiment, ball 78 is placed in throwing arm 16, as previously described when throwing arm 16 is in the cocked position illustrated in FIG. 2, and rests on top of moveable platform 38 flat support top 40 connected to support 36 comprising micro-vertical adjuster 34. At this point, throwing apparatus 10 is ready to throw the object to be thrown 78.

Referring now to FIG. 3, throwing apparatus 10 is shown in the released, forward throwing position. In order to throw an object to be thrown 78, all that is necessary is for the user, when ready, to pull release handle 18 in the rearward direction toward back 24 of base 12. Release block 62 because of its smooth angled face, smoothly releases top 26 of throwing arm 16. Once released, power section 20 is free to return to its resting position. Because power section 20 is resilient, this return is rapid and forceful. The result is that the bottom 28 of throwing arm 16 is rapidly pulled in the rearward direction towards the back 24 of base 12 causing throwing arm 16 to rotate about axle 46 so that the top 26 of throwing arm 16 is forcefully and rapidly rotated from a position at the back 24 of base 12 to the front 22 of base 12. Ball 78 rolls smoothly up the "V" shape of throwing arm 16 and is released towards the target (not shown). The self centering ability of throwing apparatus 10 results in throwing apparatus 10 returning to the resting position illustrated in FIG. 1 without need of any type of additional shock absorbers, or the like as was required in the prior art. That is, power section 20 applies tension to the throwing arm 16 in both extremes of motion, rearward and forward, so as to both move and stop throwing arm 16 and return it to the resting position.

Referring to FIG. 1, in a preferred embodiment, throwing apparatus 10 includes three speed adjustment connection locations 52: position one 82; position two 84 and position three 86. Further, in a preferred embodiment, release handle 18 includes six pitch height adjustment holes 64: position one 88; position two 90; position three 92; position four 94; position five 96 and position six 98. Referring to FIG. 4, speed and distance chart 80, illustrates that with the speed adjustment connection location in position one 82 and release block 62 located in pitch height adjustment 64 numbers one (88) to five (96), the object to be thrown will be thrown at between 20–22 mph over a distance of 30–39 feet.

Additionally, the inventors have determined through tests that with the appropriate materials and power sections 20 and the like, with speed adjustment connection 52 position two 84 used and release block positions 3 through 5 (92–96) selected a speed of 25–27 mph and a distance of 39–44 feet may be obtained.

With speed adjustment connection location 52 position three 86 used in combination with release block 62 positions 4–6 (94–98), speeds of 33–35 mph and a distance of 44–49 feet are obtained. Obviously, the speed and distances obtained are related to the size of the device, the strength of the power section 20 and the like. Minimal testing by persons of ordinary skill in the art may be necessary in order to achieve the appropriate speeds. Certainly any speeds higher or lower than these may be accomplished by simple design choices of the materials to be used. Nonetheless, the focus of the throwing apparatus 10 of the present invention is for use with children and the preferred design results in the choice of materials that yields the speeds suggested by FIG. 4, speed and distance chart 80.

The method of use of the throwing apparatus 10 of the present invention will now be disclosed. To begin with, it should be obvious that throwing apparatus 10 is easily and quickly assembled from a small number of basic parts. Applicants have determined that a very small box is sufficient to include all the parts of throwing apparatus 10 in a disassembled position. In a preferred embodiment, throwing apparatus 10 comes assembled with transverse stability bars 66 as illustrated in the figures. Arm axle mount 14 is then secured to female receiver 42 by bolt 44. Throwing arm 16 has previously been connected to axle 46 on axle mount 14 so no additional assembly is typically necessary. It is easily attached if it has not been previously attached, however. Additionally, release handle 18 is easily attached at connection 56 if it has not already been done. In this condition, the entire throwing apparatus 10 may be easily picked up by a single person. In a preferred embodiment, throwing apparatus 10 is placed facing home plate on a baseball field on flat, level ground. Once located the appropriate distance from home plate, a stake 76 is placed through stake hole 74 in the front 22 of base 12.

Next, the user chooses the pitch that is desired by reference to speed and distance chart 80 in FIG. 4. Once that is determined, eye bolt 54 is placed in the appropriate speed adjustment connection location 52 and release block 62 is placed in the appropriate pitch height adjustment hole 64. In a preferred embodiment, these locations are secured by means of a easily removable and attachable wing nuts, (not shown). Again, any means known in the art to make this connection secure is appropriate.

At that point, the user attaches power section 20 end 50, to eye bolt 54 connected to base 12 through speed adjustment connection location 52. End 48 has previously been connected to the bottom 28 of throwing arm 16.

When initially setting up throwing apparatus 10, micro-vertical adjuster 34 is adjusted by screwing moveable platform 38 to within one inch of the lowest position, as shown in FIG. 1. At that point, the user places the left foot on central stabilizer bar 68 and the right foot on the right side of rear pad transverse stabilizer 72. Throwing arm 16 is pulled rearward toward the back 24 of base 12 and the top 26 of throwing arm 16 is placed under release block 62 of release handle 18 and release handle 18 is moved and held in the forward position towards the front 22 of base 12.

While keeping forward pressure on release handle 18, the user places ball 78 in the "V" shaped ball guide of throwing arm 16. Ball 78 will come to rest on flat support top 40 of moveable platform 38. Because the release block 62 has an angled face, designed to prevent throwing apparatus 10 from being left in a cocked position, it is important, again, for the user to maintain forward pressure on release handle 18. Obviously, if desired, release handle 18 may be designed to be left in the cocked position unattended.

Ball 78 is thrown by pulling release handle 18 straight back towards back 28 of base 12. Once released, throwing arm 18 is rapidly rotated around axle 46 and throws ball 78 across the plate. If necessary, the user adjusts release block 62 down to raise the pitch and up to lower the pitch until the ball 78 crosses the plate at the desired height. At that point, micro-vertical adjuster 34 is used to move the pitch to the exact desired location. In this case, movement of micro-vertical adjuster 34 by screwing moveable platform 38 up results in the ball moving up a little. Once in the exact desired location, moveable platform 38 is held in the chosen position by any means known in the art, such as a bolt and wing nut (not shown) or the like. The back 24 of base 12 can be moved as necessary until ball 78 goes through the center of a baseball plate at the exact desired height. At that point, the user can place a rear stake 76 through stake hole 74 in the back 24 of base 12 and the user is now ready to throw pitch after pitch after pitch at exactly the desired height, speed and distance chosen.

While the throwing apparatus 10 of the present invention has been disclosed in connection with a preferred embodiment of throwing a baseball, it should be appreciated that throwing apparatus 10 can be used in other situations as well. The present invention provides an extraordinarily portable, light weight accurate throwing device which can be easily manipulated in order, for example, to lob tennis balls, volley balls, softballs, basketballs, and any other situation where a consistent repetitive accurately thrown object is desirable.

While the present invention has been disclosed in connection with the preferred embodiment thereof, it should be understood that there may be other embodiments which fall within the spirit and scope of the invention as defined by the following claims.

What is claimed is:

1. A throwing apparatus comprising:

a) a base with a front and a back;

b) an arm axle mount connected to the front of said base;

c) a throwing arm with a top and a bottom connected to said arm axle mount for moving backward and forward from a resting position;

d) a release handle connected to the back of said base for releasing the top of said throwing arm; and e) a power section for moving and stopping said throwing arm, connected to the bottom of said throwing arm and to said base, applying tension at both extremes of said movement backward and forward and applying tension tending to return said throwing arm to said resting position.

2. The apparatus of claim 1 wherein said throwing arm further comprises a pair of flat surfaces joined together along one edge so as to form a "V" into which an object to be thrown is placed for throwing.

3. The apparatus of claim 2 wherein said pair of flat surfaces are joined together so as to form a 90° degree angle.

4. The apparatus of claim 1 wherein said arm further comprises a micro-vertical adjuster.

5. The apparatus of claim 4 wherein said micro-vertical adjuster further comprises:

a) a support attached to said throwing arm; and b) a moveable platform attached to said support for vertically raising and lowering an object to be thrown.

6. The apparatus of claim 1 wherein said release handle further comprises a macro-vertical adjuster.

7. The apparatus of claim 6 wherein said macro-vertical adjuster further comprises a release block for engaging and smoothly releasing the top of said throwing arm.

8. The apparatus of claim 7 wherein said macro-vertical adjuster further comprises a plurality of vertical adjustment holes in said release handle for moveably securing said release block to said release handle.

9. The apparatus of claim 1 wherein said base further comprises a plurality of speed adjustment connection locations for said power section.

10. The apparatus of claim 1 wherein said base further comprises at least one transverse stability bar.

11. A portable, universal, ball throwing apparatus comprising:

a) a base with a front and a back;

b) an arm axle mount connected to the front of said base;

c) a throwing arm with a top and a bottom connected to said arm axle mount for moving backward and forward from a resting position, said throwing arm further comprising a pair of non-parallel flat surfaces joined together along one edge so as to form a "V" into which a ball is placed for throwing;

d) a micro-vertical adjuster connected to said throwing arm;

e) a release handle connected to the back of said base for releasing the top of said throwing arm;

f) the release handle further comprising a macro-vertical adjuster; and g) a power section for moving and stopping said throwing arm, connected to the bottom of said throwing arm and to said base, applying tension at both extremes of said movement backward and forward and applying tension tending to return said throwing arm to said resting position.

12. The apparatus of claim 11 wherein said micro-vertical adjuster further comprises:

a) a support attached to said throwing arm; and b) a moveable platform attached to said support for vertically raising and lowering the ball to be thrown.

13. The apparatus of claim 11 wherein said macro-vertical adjuster further comprises an angled, smooth faced release block for engaging and smoothly releasing the top of said throwing arm.

14. The apparatus of claim 13 wherein said macro-vertical adjuster further comprises a plurality of vertical adjustment holes in said release handle for removably securing said angled, smooth faced release block to said release handle.

15. The apparatus of claim 11 wherein said base further comprises a plurality of speed adjustment connection locations for said power section.

16. A method for throwing a ball comprising the steps of:

a) providing a base with a front and a back;

b) connecting an arm axle mount to the front of said base;

c) connecting a throwing arm with a top and a bottom to said arm axle mount moveable backward and forward from a resting position;

d) connecting a release handle to the back of said base for alternately holding and releasing the top of said throwing arm;

e) connecting a power section for moving and stopping said throwing arm to the bottom of said throwing arm and to said base and for applying tension at both extremes of said movement backward and forward and applying tension tending to return said throwing arm to said resting position;

f) pulling said throwing arm backward to a rearward position toward the back of the base;

g) holding the throwing arm in the rearward position by engaging the top of the throwing arm with said release handle;

h) placing a ball on said throwing arm;

i) moving said release handle so as to release said throwing arm so that said throwing arm is moved rapidly forward by said power section toward the front of said base thereby throwing said ball; and j) stopping said throwing arm and returning said throwing arm to said resting position by said power section.

17. The method of claim 16 further comprising the steps of forming said throwing arm by joining a pair of flat surfaces together along one edge so as to form a "V" into which the ball is placed for throwing.

18. The method of claim 16 further comprising the step of providing a micro-vertical adjuster and connecting said micro-vertical adjuster to said throwing arm.

19. The method of claim 16 further comprising the step of providing a macro-vertical adjuster and connecting said macro-vertical adjuster to said release handle.

20. The method of claim 16 further comprising the step of providing a plurality of speed adjustment connection locations for said power section.

* * * * *